US005711176A

United States Patent [19]

Komatsu

[11] Patent Number: 5,711,176

[45] Date of Patent: Jan. 27, 1998

[54] BLANKING METHOD

[75] Inventor: Isamu Komatsu, Sagamiharashi, Japan

[73] Assignee: Aida Engineering Ltd., Kanagawa-ken, Japan

[21] Appl. No.: 661,469

[22] Filed: Jun. 11, 1996

[30] Foreign Application Priority Data

Jul. 25, 1995 [JP] Japan ..... 7-209017

[51] Int. Cl.[6] ..... B21D 28/08

[52] U.S. Cl. ..... 72/336; 72/335

[58] Field of Search ..... 72/334, 333, 325, 72/327, 328, 335, 336

[56] References Cited

U.S. PATENT DOCUMENTS

| | | | |
|---|---|---|---|
| 3,434,327 | 3/1969 | Speakman | 72/335 |
| 4,711,115 | 12/1987 | Sukonnik | 72/334 |
| 5,253,416 | 10/1993 | Harland | 72/335 |

FOREIGN PATENT DOCUMENTS

| | | | |
|---|---|---|---|
| 133858 | 3/1985 | European Pat. Off. | 72/327 |
| 174233 | 10/1984 | Japan | 72/327 |
| 1242280 | 7/1986 | U.S.S.R. | 72/327 |
| 1648619 | 5/1991 | U.S.S.R. | 72/334 |
| 12137 | 10/1885 | United Kingdom | 72/327 |

*Primary Examiner*—Daniel C. Crane

*Attorney, Agent, or Firm*—Wood, Phillips, VanSanten, Clark & Mortimer

[57] ABSTRACT

Disclosed is a blanking method according to which, when producing a part by blanking from a plate material, a forming process consisting of coining is performed on the upper and lower surfaces of that portion of the plate material which becomes a scrap after the blanking. By the energy needed for this coining, the strain energy accumulated in the press as a result of the blanking of the part is absorbed. In this method, the breakthrough generated when producing parts by blanking with a press and a die can be mitigated or eliminated.

7 Claims, 3 Drawing Sheets

BLANKING METHOD

BACKGROUND OF THE INVENTION

The present invention relates to a blanking method for blanking a plate material with a die by using a press to thereby produce parts.

When producing a part by blanking from a plate material by using a press, strain energy is accumulated in various sections of the press due to the pressurizing force of this blanking process, and this strain energy is released at a stroke upon completion of the blanking. This releasing of strain energy, which is called breakthrough, involves generation of noise and vibration in the press and the die.

The following are conventional techniques for mitigating or preventing the breakthrough:

(a) In a press having a plurality of blanking punches, a step is provided on each blanking punch, and the completion of blanking with the blanking punches is effected sequentially, allowing only the pressurizing force of that blanking punch which is the last to complete blanking to have an influence on the breakthrough. In this case, the breakthrough can be reduced to a fraction of that generated in the case of the method in which all the blanking punches complete blanking at the same time, although it depends upon the punch which is the last to complete blanking.

However, this method is not generally applicable due to the fact that the maintenance such as the re-sharpening of the blanking punch takes a lot of trouble and that it is difficult in some cases to eliminate the eccentric load on the press.

(b) In the die, a counter punch is provided at a position opposed to the blanking punch, and, simultaneously with the completion of blanking, this counter punch is caused to operate so as to absorb the strain energy accumulated in the press. In this case, the strain energy accumulated in the press is absorbed by the production of the pressurizing force applied to the counter punch and the length of the operational stroke of the counter punch. In a simpler method, instead of using a counter punch, a rubber member or the like provided in the die is crushed before and after the completion of blanking to thereby absorb the strain energy.

However, the pressurizing force of the counter punch is generated by an elastic member consisting of a spring or rubber or the like due to the structural constraints of the die with respect to the installation space, etc., so that it is often impossible to secure the requisite pressurizing force of the counter punch. Further, the service life of this elastic member is rather short. Thus, this method is only applicable to special cases.

(c) A hydraulic buffer cylinder is provided between the slide and the bolster or between the slide and the bed of the press to which the die is attached. In this case, the hydraulic buffer cylinder is operated immediately before or simultaneously with the completion of blanking. The absorption of strain energy must be adjusted in terms of the buffer capacity and the buffer stroke length of the hydraulic cylinder, and this operation is required each time the die is replaced.

However, this method has also a problem in that it takes a lot of time to adjust the buffer capacity and that the strain energy is absorbed through an increase in the temperature of the oil of the hydraulic cylinder, which means the apparatus must be designed taking the dissipation of this heat into account, with the result that the apparatus becomes rather expensive.

SUMMARY OF THE INVENTION

To eliminate the above problems in the prior art, the present invention takes the following measures:

In absorbing the strain energy in the press generated as a result of blanking, plastic deformation is caused in the scrap portion remaining after producing a part from the plate material, the absorption being effected by the energy used for this plastic deformation.

To effect this plastic deformation, punches for forming are provided on the upper and lower dies, and the plate material is crushed by these punches. At least one, usually a plurality of pairs, of these forming punches are provided in accordance with the blanking layout of the die, and are arranged such that no eccentric load is generated in the slide of the press. When deformation such as warpage of the scrap is acceptable, it is possible to provide a forming punch on either the upper or the lower die, effecting forming from one side of the plate material.

This forming is started with the completion of blanking (or slightly later than that as needed) and continued until the bottom dead center of the slide is reached. When it is necessary to change the timing for the forming due to the re-sharpening of the die, etc., the height of the forming punch is changed so as to maintain the requisite stroke length for forming.

Prior to the forming, a starting hole is formed at the forming center, and a plastic flow of the portion crushed by forming is caused in this starting hole.

Of course, depending upon the arrangement of the parts to be blanked, that is, the arrangement of the blanking punches of the die, it is also possible to performing forming on the scrap portion without any starting hole and to cause a plastic flow at the positions where the parts have existed.

This blanking method can be executed in the conventional die size and does not need any complication of the die. Further, it easily allows change in timing as needed, and the strain energy can be absorbed by the plate material portion which becomes a scrap.

Thus, the present invention provides a blanking method according to which it is possible to absorb the strain energy accumulated in the press as a result of blanking.

DETAILED DESCRIPTION OF THE INVENTION

An embodiment of the blanking method of the present invention will now be described with reference to FIGS. 1, 2, 3 and 4.

Figure 1:
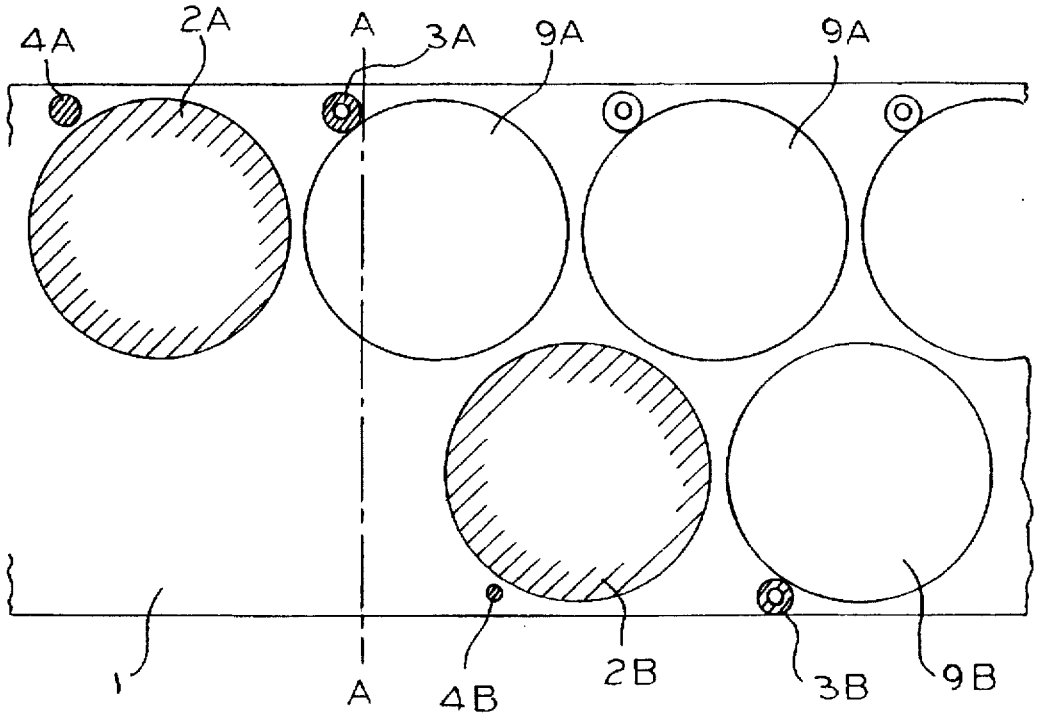
FIG. 1 shows a blanking layout according to an embodiment of the present invention, in which, prior to the coining of a plate material, a starting hole is formed at the coining center.

FIG. 1 shows a layout of the blanking of a plate material 1. While feeding the plate material 1 pitch by pitch from the left to the right as seen in FIG. 1 (conveying portions 2A and 2B of FIG. 1 to portions 9A and 9B), parts 2A and 2B are produced by blanking in two rows. Starting holes 4A and 4B are formed in the portion of the plate material 1 which becomes a scrap. Around each of these starting holes 4A and 4B, coining 3A, 3B is conducted. The center line AA, which is represented by a chain line, indicates the center with respect to the horizontal dimension of the press (not shown).

In this embodiment, the parts 2A and 2B are blanked at positions at an equal horizontal distance from the center line AA so that no eccentric load may be applied to the slide of the press (not shown).

The starting holes 4A and 4B and the coined portions 3A and 3B are not positioned at the same horizontal distance from the center line AA. However, the pressurizing force for forming the starting hole 4A and the coined portion 3A, which are closer to the center line AA than the starting hole 4B and the coined portion 3B, is made larger than the pressurizing force for forming the starting hole 4B and the coined portion 3B (In other words, the diameter on the side closer to the center line AA is made larger). In this way, there is a variation in the pressurizing force for coining. This variation is effected such that the value obtained by adding the product of the distance of the starting hole from the center line AA and the pressurizing force for forming the starting hole to the product of the distance of the starting hole from the center line AA and the pressurizing force for coining is the same on the right-hand side and the left-hand side, whereby no eccentric load is applied to the slide of the press.

In this way, the blanking of the parts 2A and 2B is effected while feeding the plate material 1 pitch by pitch from the left to the right as seen in FIG. 1.

Figures 2A, 2B, 2C, 2D:
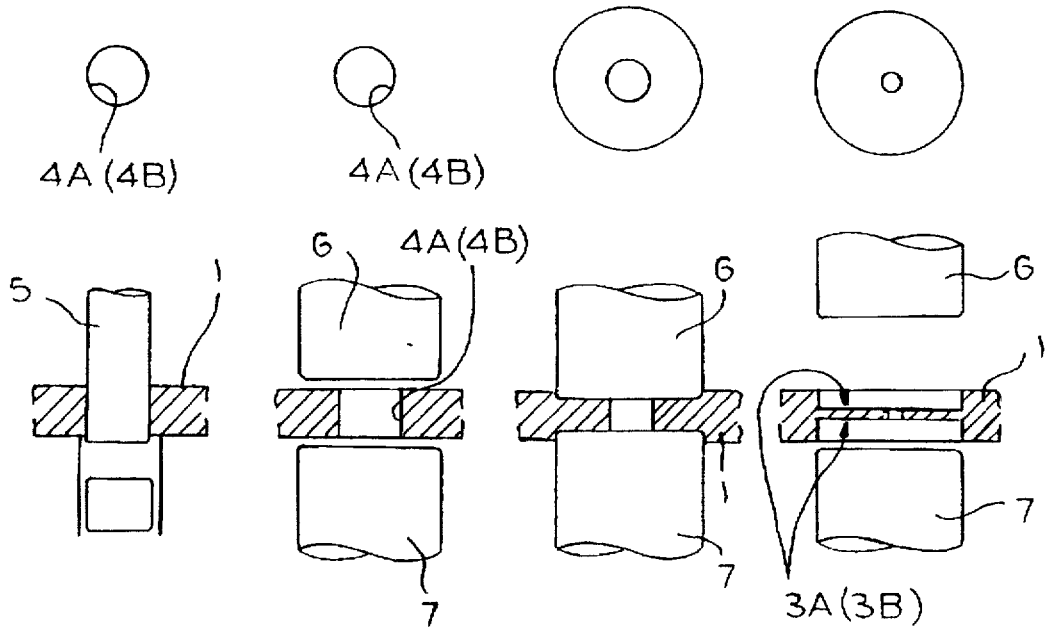
FIGS. 2(*a*)–2(*d*) are sectional views of starting holes and coined portions in the processing of FIG. 1.

FIG. 2(*a*) shows how blanking is effected on the plate material 1 with a starting-hole punch 5 to form the starting hole 4A or 4B. FIG. 2(*b*) shows the state immediately before the coining of the plate material 1 with forming punches 6 and 7 provided on the upper and lower dies, respectively. FIG. 2(*c*) shows how coining is proceeded. FIG. 2(*d*) shows the state in which the coining of the upper and lower surfaces of the plate material 1 has been completed, with the plate material having been crushed and the slide raised a little past the bottom dead center.

Figure 3A:
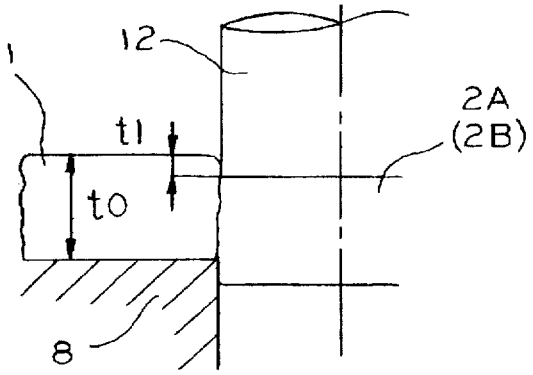
FIGS. 3(*a*) and 3(*b*) are sectional views of the blanking of the parts of FIG. 1.
Figure 3B:
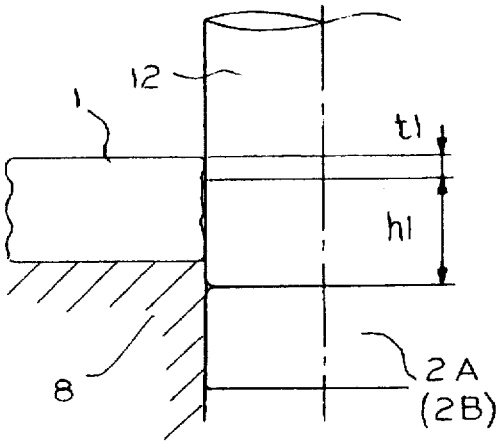
Figure 4A:
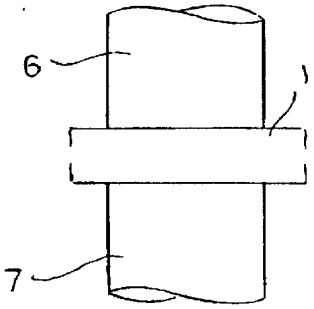
FIGS. 4(*a*)–4(*d*) is a diagram showing the relationship between the tip configuration of the forming punch and the pressurizing force for coining.
Figure 4B:
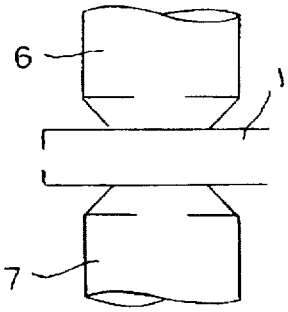
Figure 4C:
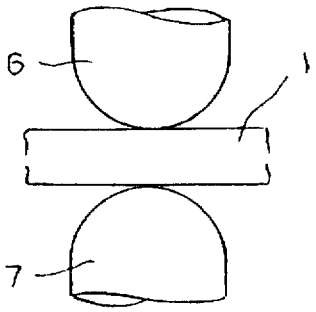
Figure 4D:
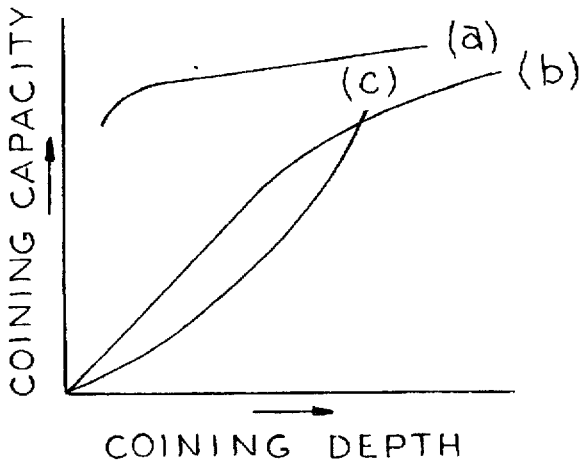

FIG. 3(*a*) shows the state in which a punch 12 for blanking the part 2A or 2B has been forced into the plate material 1, which has a thickness of t0, to a depth of t1 to start rupture, with the part 2A or 2B being about to be separated from the plate material 1. Due to the pressurizing force needed for this rupture, strain energy is accumulated in various sections of the press (not shown), e.g., the frame thereof. This state is referred to as the "blanking complete" state. After this, the slide reaches the bottom dead center, as shown in FIG. 3(*b*), blanking being effected over a distance of h1. It is naturally possible for the coining to be started immediately before the blanking punch has been forced to the depth t1 or somewhat later than that.

FIGS. 4(*a*), 4(*b*) and 4(*c*) show the configurations of the tips of forming punches, and FIG. 4(*d*) shows the relationship between the coining depth and the requisite pressurizing force for the coining when these punch tip configurations are adopted. In order that the strain energy to the press is absorbed so as to avoid breakthrough, a forming punch tip configuration is selected which is suitable for mitigating the generation of noise and vibration during the processing taking into account the properties of the plate material 1 and the part to be produced therefrom by blanking.

Figure 5:
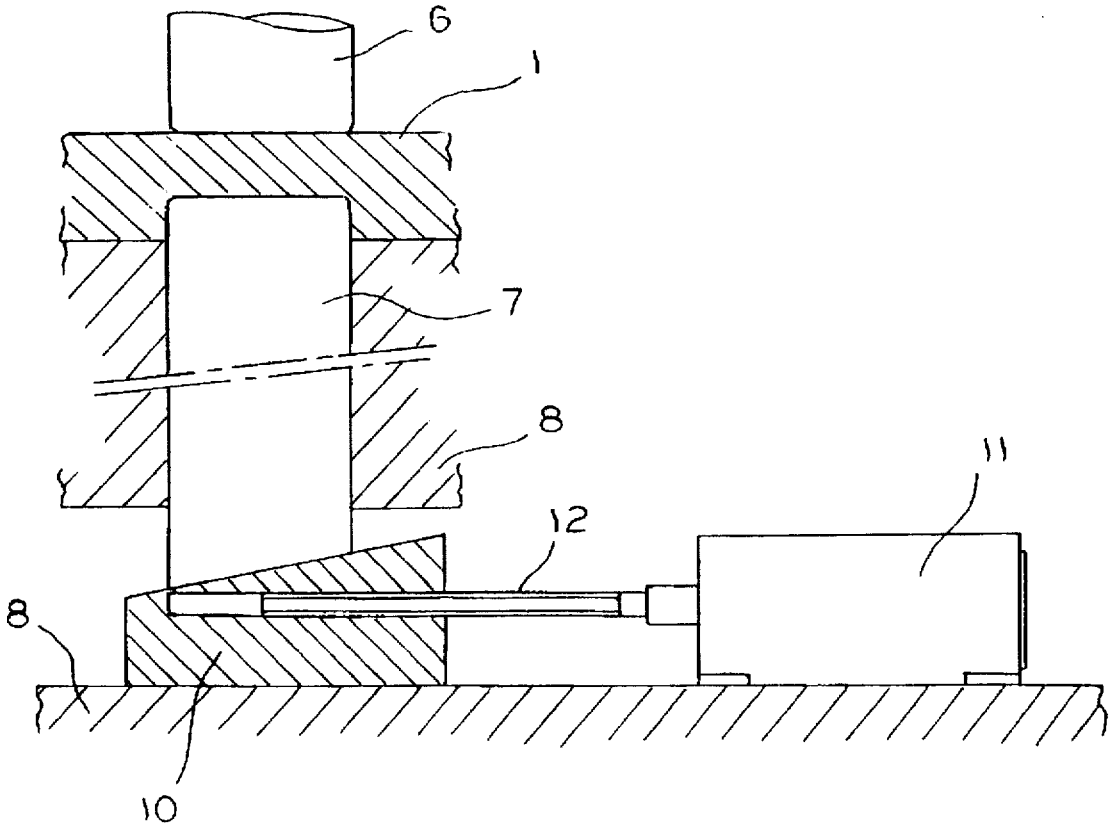
FIG. 5 is a sectional view of a vertical adjustment portion for a forming punch.

FIG. 5 shows an embodiment of a mechanism for adjusting the height of the forming punch 7. The lower surface of the forming punch 7 is formed as a tapered surface, and a wedge 10 having a correspondingly tapered surface is provided. A screw shaft 12 connected to the output shaft of an adjusting motor 11 is threadedly engaged with the wedge 10. The motor 11 is rotated to move the wedge 10 to the right and left as seen in FIG. 5 to thereby adjust the height of the forming punch 7. It goes without saying that it is also possible to use some other rotary driving source in place of the motor 11 or move the wedge manually.

Next, the actual relationship between blanking and coining will be described with reference to an example.

The requisite shearing force (f) for blanking a round part under the following conditions: plate thickness (t): 15 mm; shearing stress per $mm^2$ ($\sigma$): 500 Mpa; diameter (D): 300 mm, is obtained as follows:

$$f = \pi * D * t * \sigma/980$$
$$= \pi * 30 * 1.5 * 500/980 \approx 72 \text{ kN}$$

Assuming that the deformation ($\delta$) of the press at this time is 2 mm, the strain energy (Ef) accumulated in the press is given as follows:

$$Ef = \delta * f$$
$$= 2 * 72 = 144 \text{ kN} - \text{mm}$$

To absorb this strain energy, coining is performed as follows: Assuming that the total of the coining strokes (L) of the forming punches provided on the upper and lower dies is 10 mm, the average pressurizing force (Pi) for coining is given as follows:

$$Pi = Ef/L$$
$$= 144/10 = 14.4 \text{ kN}$$

Assuming that the requisite coining surface pressure (P) is 1500 Mpa per $mm^2$ and that two sets of forming punches are used, the area (Mp) of the forming punches is given as follows:

$$Mp = Pi/(2 * P)$$
$$= 14.4/(2 * 1500) = 471 \text{ mm}^2$$

The diameter of the forming punches having this area Mp is approximately 25 mm. When one set of forming punches are used, the diameter of the forming punches is approximately 30 mm.

There is no difficulty in performing coining in a diameter of approximately 25 mm or 30 mm on the scrap portion remaining after producing a round part having a diameter of 300 mm by blanking from a plate material.

By the blanking method as described above, the problems in the prior art can be eliminated. That is, by performing coining on the scrap portion of a plate material, the strain energy of the press generated when a part is produced by blanking from a plate material can be absorbed reliably and in an optimum manner (in an appropriate amount). Further, the scrap portion of the plate material is effectively utilized to make it possible to absorb the strain energy of the press, without entailing any wear of an elastic member such as a spring or a rubber member as in the prior art. The layout inside the die can be freely determined, and there is no need, for example, to dissipate heat in the hydraulic cylinder, thereby simplifying the mechanism and providing an inexpensive construction having a long service life. Further, since it is possible to accommodate the mechanism in the die, there is no need to perform adjustment each time the die is replaced.

What is claimed is:

1. A blanking method for producing parts by blanking from a plate material with a die by using a press, the method comprising the steps of:

performing blanking on the plate material to produce parts, the die being forced into the plate material such that the part is about to be separated from the plate material, defining a blanking complete state, and thereafter until the die reaches a bottom dead center position, an area of the plate material proximate a blanked area defining scrap;

feeding the plate material subsequent to each blanking step so that the scrap is spaced from the die;

subjecting upper and lower surfaces of the area of the plate material defined as scrap to a forming process with at least one set of upper and lower punches, beginning approximately with the blanking complete state of the blanking step until the die reaches the bottom dead center position, to thereby absorb strain energy accumulated in the press as a result of blanking to prevent breakthrough of the press.

2. The blanking method of claim 1 further comprising the step of adjusting at least one of the upper and lower punches in height to vary timing of start of the forming process.

3. The blanking method of claim 1 further comprising the step of punching a starter hole in the scrap at a position of the plate material where the forming process is to be performed so that plate material flows into the starter hole during the forming process.

4. A blanking method for producing parts by blanking from a plate material with a pair of dies by using a press, the dies being at equal horizontal distance from a centerline of the press, the method comprising the steps of:

performing blanking on the plate material to produce parts, each die being forced into the plate material such that the parts are about to be separated from the plate material, defining a blanking complete state, and thereafter until the dies reach a bottom dead center position, an area of the plate material proximate a blanked area defining scrap;

feeding the plate material subsequent to each blanking step so that the scrap is spaced from the dies;

subjecting upper and lower surfaces of the area of the plate material defined as scrap to a forming process with at least one set of upper and lower punches, beginning approximately with the blanking complete state of the blanking step until the die reaches the bottom dead center position, to thereby absorb strain energy accumulated in the press as a result of blanking to prevent breakthrough of the press.

5. The blanking method of claim 4 further comprising the step of adjusting at least one of the upper and lower punches in height to vary timing of start of the forming process.

6. The blanking method of claim 4 further comprising the step of punching a starter hole in the scrap at a position of the plate material where the forming process is to be performed so that plate material flows into the starter hole during the forming process.

7. The blanking method of claim 4 wherein the subjecting step uses two sets of upper and lower punches, each set being associated with one of the dies.

* * * * *